US007077123B2

(12) United States Patent
Järvinen

(10) Patent No.: US 7,077,123 B2
(45) Date of Patent: Jul. 18, 2006

(54) ISOLATION SHIELD SYSTEM, INSOLATION SHIELD AND METHOD

(76) Inventor: Simo Järvinen, Puskiaistentie 101, FIN-37560, Lempäälä (FI)

( * ) Notice: Subject to any disclaimer, the term of this patent is extended or adjusted under 35 U.S.C. 154(b) by 11 days.

(21) Appl. No.: 10/468,583

(22) PCT Filed: Feb. 20, 2002

(86) PCT No.: PCT/FI02/00137

§ 371 (c)(1),
(2), (4) Date: Mar. 5, 2004

(87) PCT Pub. No.: WO02/066763

PCT Pub. Date: Aug. 29, 2002

(65) Prior Publication Data

US 2004/0134482 A1 Jul. 15, 2004

(30) Foreign Application Priority Data

Feb. 20, 2001 (FI) ..... 20010079 U

(51) Int. Cl.
*F24J 2/40* (2006.01)

(52) U.S. Cl. ..... 126/573; 126/701

(58) Field of Classification Search ..... 126/573, 126/702, 703, 701, 572, 623, 624, 621, 600; 136/206, 245
See application file for complete search history.

(56) References Cited

U.S. PATENT DOCUMENTS 2,969,918 A * 1/1961 Phelps ..... 126/573
4,159,707 A * 7/1979 Miquel ..... 126/702
4,432,609 A * 2/1984 Dueker et al. ..... 126/701
4,505,255 A * 3/1985 Baer ..... 126/702
4,621,615 A * 11/1986 McGee ..... 126/572
4,622,470 A * 11/1986 Makino et al. ..... 126/701
4,742,813 A 5/1988 Riehl et al. ..... 126/425
5,142,133 A 8/1992 Kern et al. ..... 250/203.4
5,663,621 A 9/1997 Popat ..... 318/480
6,134,842 A * 10/2000 Cheng et al. ..... 126/702

FOREIGN PATENT DOCUMENTS

DE 4300348 A1 3/1995
DE 199 56 648 A1 * 9/2000
EP 0593201 A1 4/1994
EP 0916781 A1 5/1999
WO WO 99/61721 12/1999

OTHER PUBLICATIONS

Patent Abstracts of Japan Publication No. 02-091348.

* cited by examiner

*Primary Examiner*—Josiah C. Cocks
(74) *Attorney, Agent, or Firm*—Perman & Green, LLP.

(57) ABSTRACT

The present invention relates to an insolation shield (3) which is arranged to be placed in connection with a building (1) to suppress solar radiation incident on the building. The insolation shield (3) comprises at least one shield element (8). At least one shield element (8) of the insolation shield (3) comprises at least one solar energy converter (4) to conduct incident solar energy to a target of consumption and/or storage. The insolation shield also comprises at least one control means (10) which is arranged to control the position of said at least one shield element (8) on the basis of the direction of incident beams on the control element (10).

17 Claims, 7 Drawing Sheets

ISOLATION SHIELD SYSTEM, INSOLATION SHIELD AND METHOD

Figure 1:
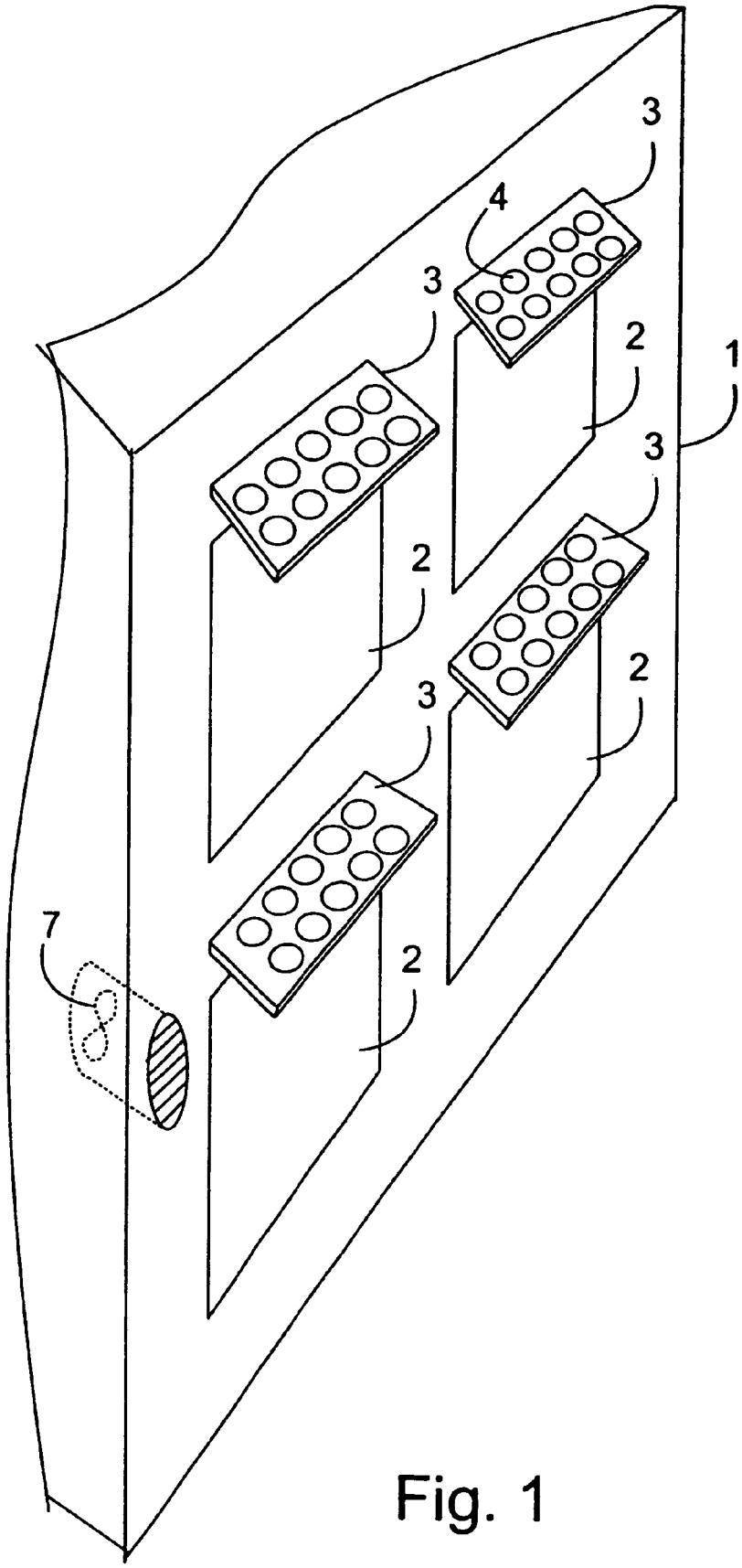

This application claims the benefit of the earlier filed International Application No. PCT/FI02/00137, International Filing Date, 20 Feb. 2002, which designated the United States of America, and which international application was published under PCT Article 21(2)as WO Publication No. WO 02/066763 A1.

The present invention relates to an insolation shield system comprising at least one shield element which is arranged to be placed in connection with a building to suppress solar radiation on the building. The invention also relates to an insolation shield comprising at least one shield element which is arranged to be placed in connection with a building to suppress solar radiation incident on the building. Furthermore, the invention relates to a method for suppressing solar radiation incident on a building by means of at least one insolation shield comprising at least one shield element, and in which method the insolation shield is placed in connection with the building.

Venetian blinds are known to be used as insolation shields to suppress solar radiation in a room. These Venetian blinds are normally fixed in the interspace between window panes in such a way that the position of the laths of the Venetian blinds can be adjusted to achieve the necessary suppression of radiation. Furthermore, these laths can be lifted up, if necessary, almost completely from the front of the window.

Also, Venetian blinds have been manufactured which are fixed above a window in a room. Thus, it will not be necessary to drill holes in the window frame for the adjustment of the Venetian blind. In such a solution, the warming up of the room caused by solar radiation is stronger than in the solution in which the Venetian blinds are placed in the window interspace. In both of these solutions, it is possible to achieve substantially equal attenuation of light emitted by the sun.

Recently, buildings have been constructed, in which the insolation shields are placed outside the building, for example in front of or above the windows. With this arrangement, it is possible to reduce unnecessary warming up of the building by the effect of solar radiation. Particularly in such buildings, in which a large part of the facade is formed by glass, this kind of a solution is useful in the warm season. The outer wall is provided with fastening means for fastening the insolation shields. Furthermore, when using insolation shields with the facility of adjustment, the necessary adjusting mechanisms must be provided so that the suitable adjusting position can be set each time, preferably from the room.

Consequently, insolation shields according to prior art are used to suppress solar radiation, primarily light and during the warm season also thermal radiation, entering the rooms of a building.

Solar energy converters are known, which can be used to convert solar light energy to electrical energy, or to recover thermal energy e.g. in a heating fluid. However, a problem in such solutions is, for example, that the solar energy converters are not necessarily in the most advantageous position in relation to the direction of solar radiation, because the sun moves during the day. Thus, the efficiency is not the best possible. This situation can be improved by manually adjusting the position of the solar energy converters, but this may be difficult and, on the other hand, it is easily neglected.

Now, the purpose of the present invention is to provide an insolation shield, in which the aim is, in addition to the effect of suppressing solar radiation, to utilize the energy contained in solar radiation in a more effective way than in the solutions of prior art. The invention is based on the idea that the insolation shield is equipped with at least one adjusting means for adjusting the direction of the shield elements (laths) on the basis of the position of the sun. This energy can be stored or conducted directly to a target of consumption. To put it more precisely, the insolation shield system according to the present invention is primarily characterized in that at least one shield element of the insolation shield system comprises at least one solar energy converter for conducting the solar energy focused on it to a target of consumption and/or storage, and that the insolation shield system comprises at least one adjusting means with means for measuring the intensity of solar radiation to determine the direction of incidence of sunbeams, wherein the position of at least one shield element is arranged to be adjusted on the basis of the direction of incidence of the sunbeams on the control element. The insolation shield according to the present invention is primarily characterized in that at least one shield element of the insolation shield comprises at least one solar energy converter for conducting the solar energy incident on it to a target of consumption and/or storage, and that the insolation shield comprises at least one adjusting means with means for measuring the intensity of solar radiation to determine the direction of incidence of sunbeams, wherein the position of at least one shield element is arranged to be adjusted on the basis of the direction of incidence of the sun beams on the adjusting element. Furthermore, the method according to the invention is primarily characterized in that at least one shield element of the insolation shield comprises at least one solar energy converter, wherein solar energy incident on the solar energy converter is conducted to a target of consumption and/or storage, and that at least one adjusting means is used for measuring the intensity of solar energy to determine the direction of incidence of sunbeams, wherein the position of said at least one shield element is adjusted on the basis of the direction of incidence of the sunbeams.

Considerable advantages are achieved with the present invention when compared with insolation shields of prior art. With the insolation shield according to the invention, it is possible to utilize solar energy incident on the insolation shield more efficiently e.g. in the air conditioning, heating and/or illumination of a room. According to the solution of the invention, when the sun is shining, the position of the solar energy converters is as advantageous as possible in relation to the position of the sun, wherein solar energy is recovered by the solar energy converters in the form of thermal energy and/or electrical energy in a more effecient way than in the form of solar energy. The adjustment of the position of the shield elements according to the direction of incidence of the sunbeams has also the advantage that the light-protecting effect of the shield elements is the best possible, in spite of the movement of the sun. Moreover, there is no need for manual adjustment, wherein the use is more convenient than the use of solutions of prior art. If necessary, solar energy can also be stored either as thermal energy or by converting it to electrical energy which can be used to charge batteries. In the use of insolation shield panels according to the invention, separate solar panels or solar cells will not be necessary, wherein it is possible to save construction costs. Furthermore; the electric energy generated in the solar panels can be utilized particularly in improving the air conditioning and in the lighting of rooms. Thus, it is possible to design the air conditioning of the building to be of lower capacity and, particularly in the warm season, to take the energy needed for additional air conditioning, from the insolation shields. The insolation shields according to the invention can be arranged to be controllable so that even though the quantity of solar radiation is adjusted in the room, this will not have a significant effect on the quantity of energy produced by the insolation shield. Insolation shields according to the invention can also be made suitable for retrofitting, wherein for example in connection with repairings of buildings, it is possible to install insolation shields of the invention or to replace existing insolation shields with insolation shields of the invention.

Figure 2:
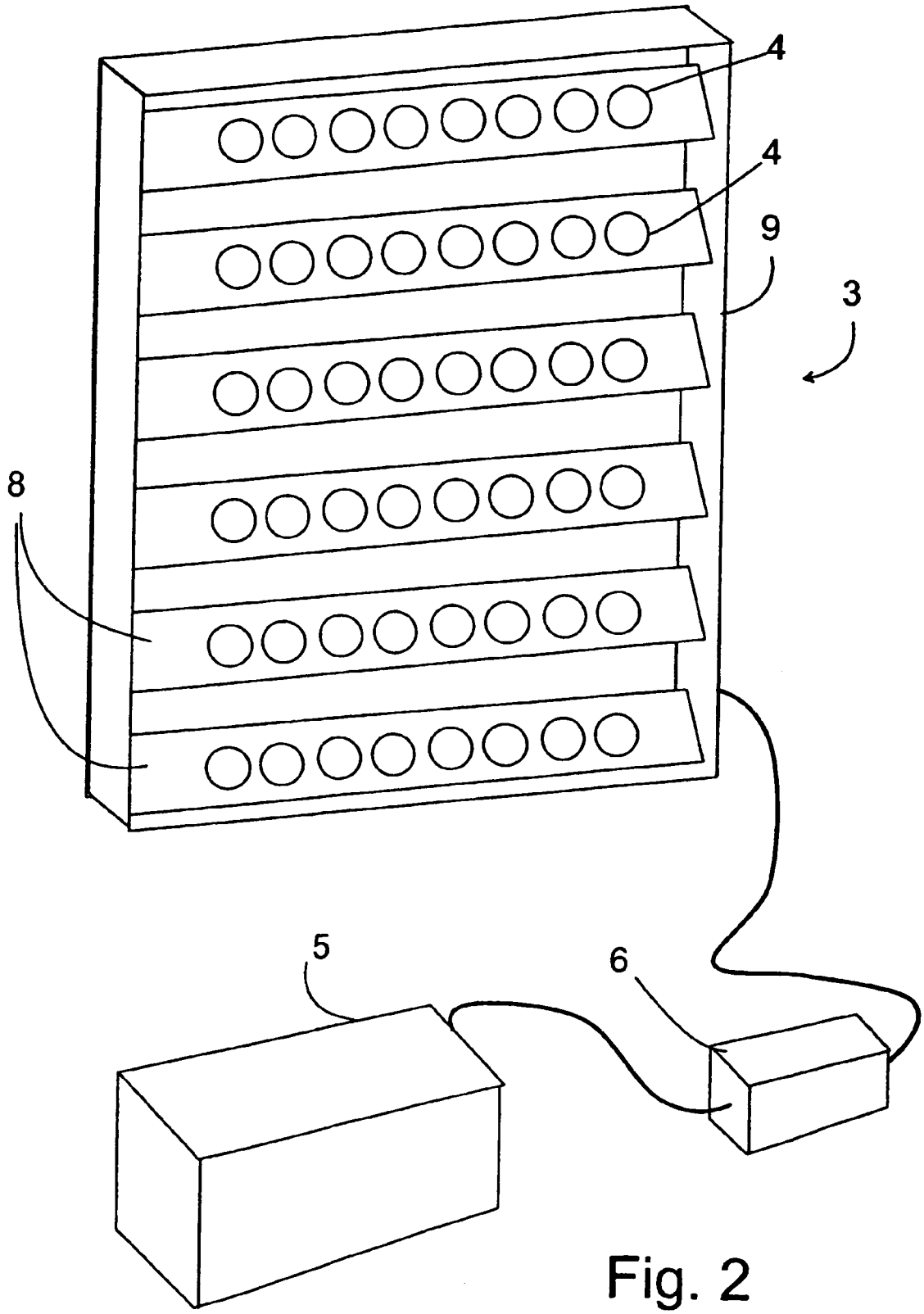
Figure 3A:
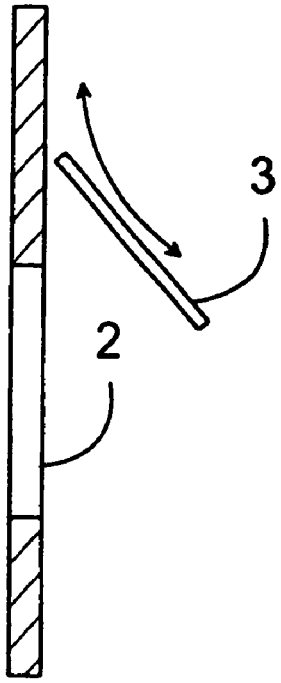
Figure 3D:
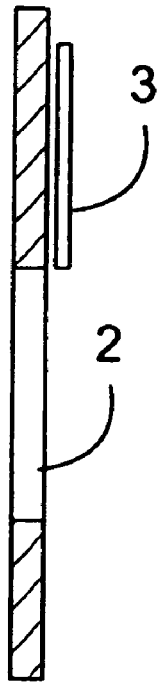
Figure 3B:
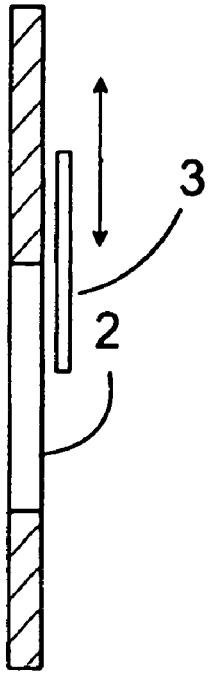
Figure 3E:
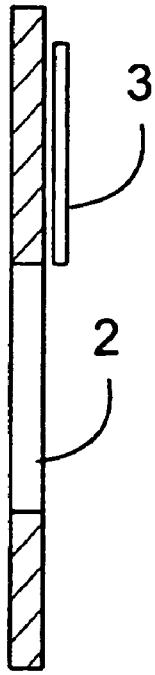
Figure 3C:
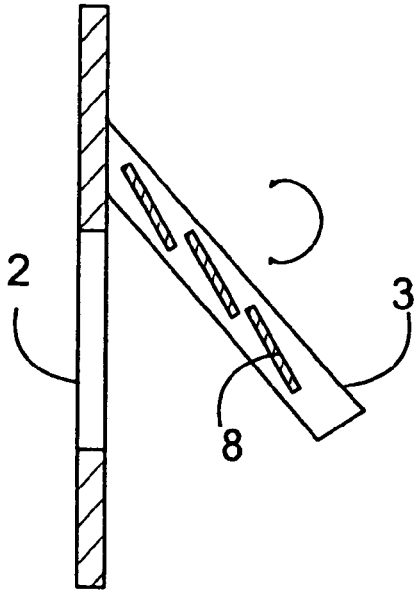
Figure 3F:
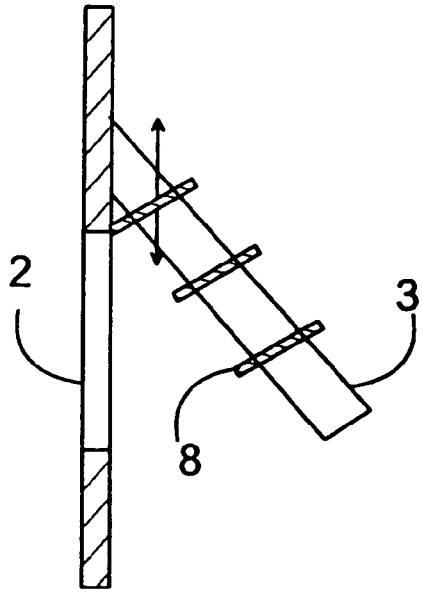
Figure 4A:
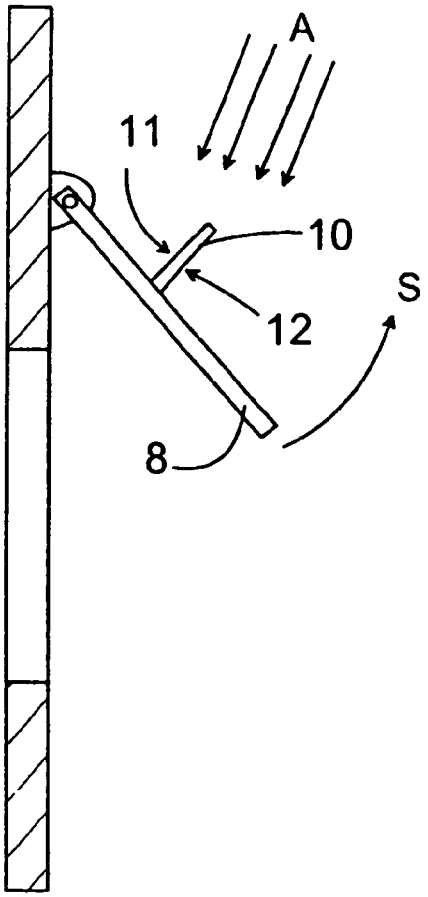
Figure 4B:
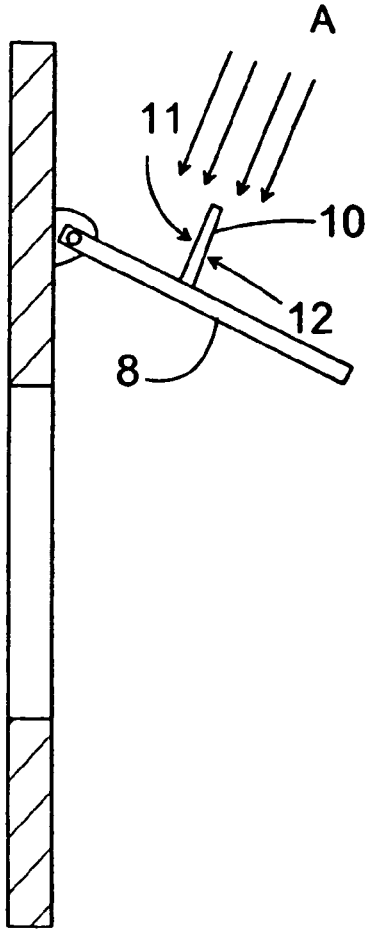
Figure 4C:
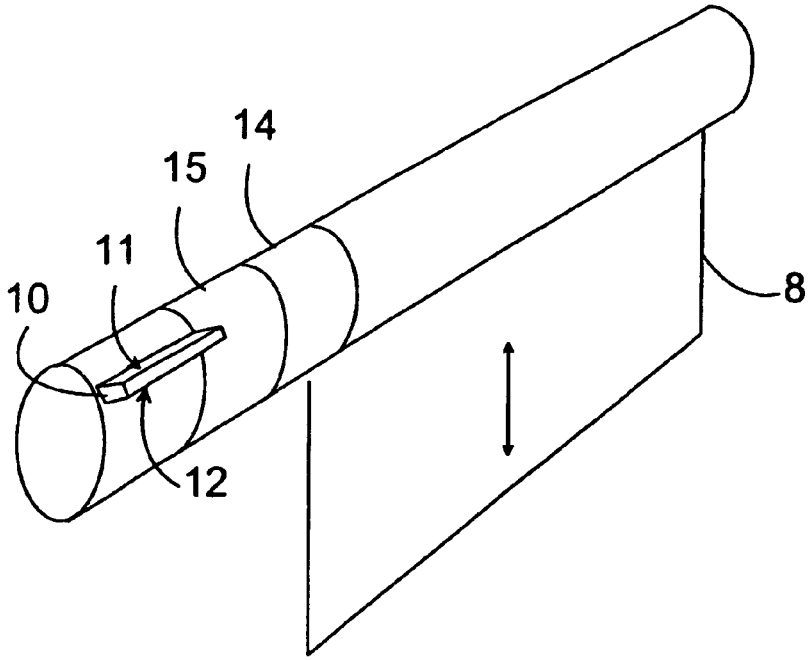
Figure 4D:
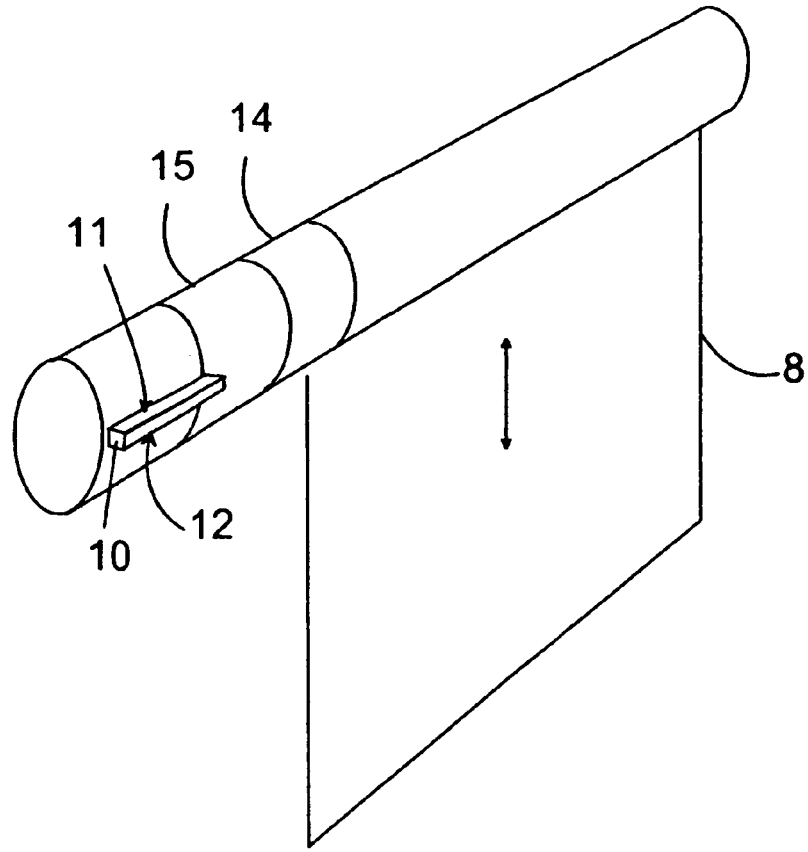
Figure 4E:
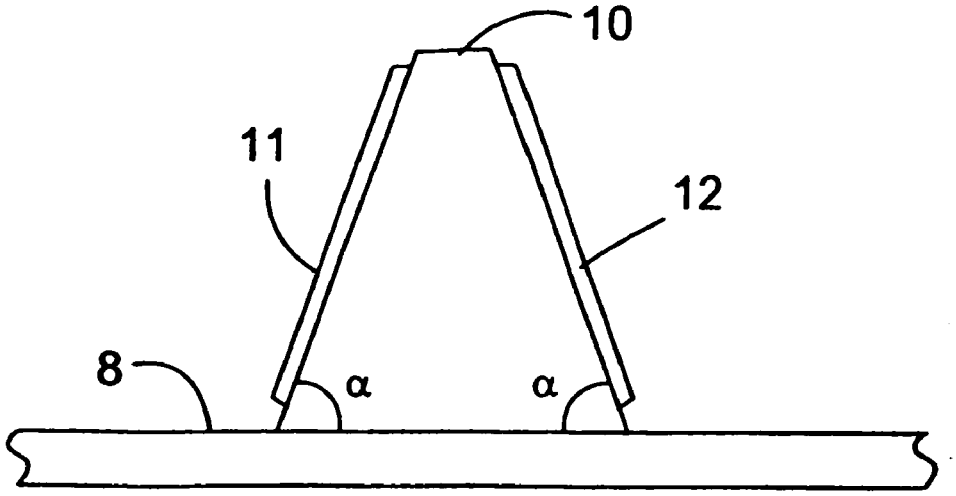
Figure 5:
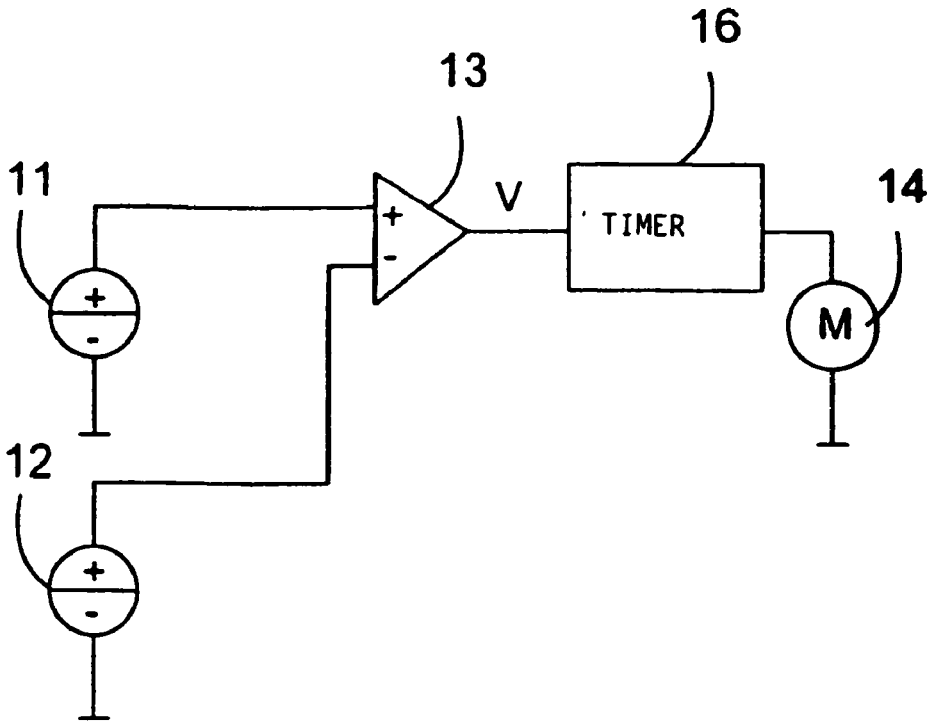

In the following, the invention will be described in more detail with reference to the appended drawings, in which FIG. 1 shows an insolation shield according to an advantageous embodiment of the invention, installed on the outer wall of a building, FIG. 2 shows an insolation shield according to another advantageous embodiment of the invention in a reduced view, FIGS. 3*a* to 3*f* show different control positions of insolation shields according to different embodiments of the invention, FIGS. 4*a* and 4*b* illustrate the operating principle of controlling the insolation shield according to an advantageous embodiment of the invention with a control means, FIGS. 4*c* and 4*d* illustrate the operating principle of controlling the insolation shield according to another advantageous embodiment of the invention with a control means, FIG. 4*e* illustrates a structure of a control means for the insolation shield according to an advantageous embodiment of the invention, and FIG. 5 shows the structure of the control circuit for the insolation shield according to a preferred embodiment of the invention in a reduced block chart.

FIG. 1 shows a part of the facade of a building 1, in which insolation shields 3 according to an advantageous embodiment of the invention are placed above windows 2. The insolation shields 3 comprise one or more shield elements 8 consisting of one or more solar energy converters 4, such as solar cells. The facade is provided with brackets or the like (not shown), to which the insolation shields 3 can be fastened with fastening means in a way known as such so that the position of the shield elements 8 of the insolation shields can be changed, if necessary. The insolation shields 3 are installed so that the solar radiation entering a room is suppressed to such an extent which is necessary in each situation. Factors affecting this include, for example, the warmth of the climate in the region, such as the average temperature in the warm season. Furthermore, the orientation of the solar energy converter 4 towards the sun is taken into account in the installation. This is easy to take into account particularly on walls facing the south, but this orientation should be considered more on walls facing the north, for the solar energy converter 4 to yield a maximum quantity of electrical energy.

We shall next describe the control operation of the insolation shield system according to an advantageous embodiment of the invention particularly with reference to FIGS. 4*a* and 4*b*. The system comprises one or more insolation shields 3 comprising one or more control means 8. Preferably, one shield element 8 is provided with a control means 10 comprising a first measuring means 11 and a second measuring means 12. The measuring means 11, 12 are photosensitive means, such as light diodes, solar cells, or the like, which generate an electrical signal proportional to the luminous intensity. The control means 10 is fastened to that planar surface of the shield element 8 which is to be oriented towards the sun. The control means 10 is placed in a position, in which the measuring means 11, 12 are substantially perpendicular to the planar surface of the shield element. Moreover, these measuring means 11, 12 are preferably substantially parallel, but they can also be placed diagonally so that the first measuring means 11, the second measuring means 12 and the planar surface of the shield element constitute an isosceles triangle whose sides are formed by the measuring means. This is illustrated in the appended FIG. 4*e*. In said case, in which the measuring means 11, 12, are substantially parallel, the angle $\alpha$ is substantially 90°.

The measuring means 11, 12 generate a signal, preferably a voltage, whose intensity is proportional to the intensity of light incident on the surface of the measuring means 11, 12. The signals generated by the first and second measuring means are conducted to the first 13*a* and second 13*b* inputs of a reference means 13, respectively. On the basis of the difference between these measuring signals, a control signal V is generated in the reference means 13 and is input in a motor 14 or the like. The motor 14 changes the position angle of the shield elements 8 of the insolation shield to reduce the difference between the measuring signals formed by the first 11 and second 12 measuring means. The adjusting is iterated until the difference reaches a predetermined target value, preferably a minimum. Thus, the position of the control means 10 is such that the intensity of light incident on the surfaces of both measuring means 11, 12 is substantially equal. In the example situation of FIG. 4*a*, the intensity of solar radiation A incident on the surface of the first measuring element 11 is higher than the intensity of solar radiation A on the surface of the second measuring means 12, wherein the control signal V is used to control the motor 14 to turn the shield elements 8 in the direction indicated with an arrow S. In a corresponding manner, if the intensity of incident light on the surface of the second measuring means 12 is higher than the intensity of incident light on the surface of the first measuring means 11, the control means 13 will generate a control signal which makes the motor rotate in the other direction, to turn the shield element in the direction opposite to the direction of the arrow S. Although FIGS. 4*a* and 4*b* show only one shield element 8 to be turned, it will be obvious that there can also be more shield elements, wherein all of these are preferably controlled by the same motor 14, by means of a control signal generated by a single control means 10. Consequently, a separate control means 10 will not be needed for each shield element 8, but preferably one control means 10 will be sufficient.

Each insolation shield 3 may comprise a separate motor or, with appropriate arrangements, in some applications a single motor can be used to adjust the position of the shield elements of two or more insolation shields 3. This can be exemplified by a system, in which a building is provided with insolation shields placed on one wall, in connection with windows in the wall. The building may comprise several storeys. Thus, in some cases, it is possible to arrange one motor to adjust the shield elements 8 of the insolation shields 3 placed in connection with windows of the same storey.

In practical applications, the signals generated by the first 11 and second 12 measuring means are not necessarily equal, even though the surfaces of both of the measuring means 11, 12 were exposed to the same intensity of light. Thus, these differences can be compensated by measuring the signal difference and by correcting the control signal V generated in the reference means 13 on the basis of this difference. Thus, said predeteremined target value is not a minimum value but the signal difference in a situation of compensation. This correction of tolerance errors is prior art known by anyone skilled in the art, wherein it is not necessary to describe it in more detail in this context.

Although it has been presented above that the control means is fastened to one shield element 8, it will be obvious that the invention is not limited solely to such applications. The invention can also be applied in such a way that the control means 10 is placed apart from the solar energy converters, for example on the outer wall of the building. Thus, the signal generated by the control means 10 is transmitted to the reference means, as above, and the reference means 13 is used to generate the control signal. This control signal V is conducted to one or more motors 14 or corresponding means to adjust the position of the shield elements 8. In this embodiment, the control means 10 is preferably used to adjust the position of shield elements 8 placed on the same wall. Thus, it is possible to equip each such wall of the building, on which adjustment is needed, with a control means 10 and to use this control means for adjusting the position of the shield elements placed on the same wall.

In the above-described embodiment, in which the control means 10 is apart from the shield elements, the control means 10 can be implemented to be turnable. Thus, the control means 10 is provided with a separate motor or corresponding means (not shown), by which the position of the control means can be adjusted in relation to the direction of incidence of sunbeams. Thus, signals generated by the control means 10 are used to find such a position of the control means 10 in which the intensity of incident light on the surfaces of both the measuring means 11, 12 is substantially equal. According to this position, also the position of the shield elements 8 is adjusted so that they form a substantially right angle with the position of this control means 10, as presented above in connection with the description of the first advantageous embodiment.

In this embodiment, the control means can also be fixed in a stationary position on the wall of the building. Thus, a table or the like can be drawn up of the signals of the measuring means 11, 12, to find out, each time, the most advantageous position of the shield elements in relation to the direction of incident sunbeams. This table or the like can be drawn up, for example, empirically. Values corresponding to the ratio of signals from the first 11 and second 12 measuring elements with different directions of incident sunbeams are placed in the table. Using the signal ratio gives the advantage that possible changes, caused by impurities in the air, cloud layer, soiling of the surface of the measuring elements 11, 12, and aging of the measuring elements 11, 12, in the values of the absolute measuring signal (sensitivity variations) do not substantially affect the control functions. This fixed mounting has the advantage that there is no need to change the position of the control means 10, wherein the structure becomes mechanically simpler and is less susceptible to damage.

We shall now describe the control operation of the insolation shield according to an advantageous embodiment of the invention particularly with reference to FIGS. 4*c* and 4*d*. In this embodiment, the shield elements 8 are not turnable, but they are glidable and may be partly rolled up by a revolving movement of a revolving means, such as the motor 14, or the like. The control means 10, which also in this embodiment comprises a first measuring means 11 and a second measuring means 12, is not directly fastened to the shield element 8 but in connection with the revolving means. This revolving means is used to glide the shield element either up or down. The angle of rotation of the control means 10 is proportional to the revolution of the revolving means. In the arrangement according to FIGS. 4*c* and 4*d*, when the revolving means revolves clockwise, the control means revolves counterclockwise. Thus, the aim is that when the incident sunbeams are high, with a relatively sharp angle, less of the shield element 8 is in front of the window. Thus, the control means 10 may even be almost upright. In a corresponding manner, when the sun shines lower, the shield element 8 is shifted so that the surface of the shield element 8 covering the window is larger. Thus, the control means 10 may even be in the horizontal position, when the sun shines right above the horizon. If necessary, the revolution of the control means 10 is arranged by means of a transmission mechanism 15 (gearbox) to match with the revolution of the revolving means between the extreme positions.

If necessary, the control arrangement according to the invention can be switched off, for example for night time, wherein possible light sources in the environment will not cause unnecessary control movements. Furthermore, if necessary, it is possible to arrange a substantially opaque shield (not shown) in the vicinity of the control means 10, to prevent the effect of possible reflections or strong artificial light sources on the control function. Due to the relatively slow movement of the sun, the control function does not need to be continuous, but it can be arranged to be intermittent. Thus, signals generated by the measuring elements 11, 12 of the control means 10 are conducted to the motor 14 or the like at intervals of, for example 30 min, 45 min or an hour, to adjust the position of the shield elements 8, when necessary. The timing can be performed, for example, by means of a timer 16 shown in FIG. 5. If such a timing is not needed, also a timer 16 is not necessarily required.

Furthermore, the insolation shield 3 is provided with conductors, by means of which the electric energy produced by the solar energy converter 4 can be conducted to a desired location, for example a current supply system (not shown) or a storage battery 5 (FIG. 2), in which the electric energy is stored. If a room-specific storage battery is used, these electrical conductors are introduced, preferably through the wall, to the room in which the storage battery 5 is placed. The storage battery 5 is provided with the necessary control equipment 6 for controlling the charging and discharging of batteries in the storage battery 5. This is necessary to prevent the batteries of storage battery 5 from being damaged by overvoltage or undervoltage. The storage battery 5 can be used to drive, for example, a fan 7 for improving the air conditioning of the room. This is useful particularly in the warm season, because solar radiation tends to warm the building and the rooms in it. This is taken into account in the design of the capacity of the air conditioning systems (not shown), to keep the temperature in the rooms of the building at a comfortable level. When insolation shields 3 according to the invention are used, the air conditioning can be designed to have a slightly lower cooling capacity, because the electrical energy generated by the insolation shield 3 can be used to achieve the required additional cooling. The need for additional cooling is often the greatest when solar radiation is most intense, wherein also the electrical energy generated by the solar panels is at its highest. Furthermore, it is possible to reduce the consumption of electrical energy supplied from the electrical network in the building, and thereby to reduce the consumption of fuel used for generating electricity and the pollution load on the environment.

It is obvious that if which no storage battery 5 is used, the electricity to be produced by the solar panels 4 will be conducted directly e.g. to a fan 7, but the extra energy generated by the solar energy converter can thus not be stored. On the other hand, on a warm but cloudy day, the electrical energy generated by the solar energy converter may not necessarily be sufficient to provide the additional air conditioning needed.

FIG. 2 shows an insolation shield 3 according to another advantageous embodiment of the invention in a reduced perspective view. In this embodiment, the insolation shield comprises several shield elements 8 consisting of solar panels 4. These shield elements 8 can be arranged to be adjustable preferably so that their angle in relation to the frame 9 is changed. Thus, the angle can be changed according to the position of the sun each time, to achieve as efficient suppression of solar radiation as possible. The control mechanisms used for these shield elements 8 can be mechanisms known as such, wherein it will not be necessary to describe them in more detail in this context.

FIGS. 3*a* to 3*f* show some advantageous insolation shields which are also provided with the control facility. FIGS. 3*a*, 3*b* and 3*c* show the insolation shields 3 in a first position, in which solar radiation is suppressed. In a corresponding manner, FIGS. 3*d*, 3*e* and 3*f* show the insolation shields 3 in a second control position, in which they do not significantly suppress solar radiation incident on a room. However, during times of daylight, these insolation shields generate electrical energy also in this second control position.

In the insolation shields 3 according to the invention, it is possible to use solar panels 4 known as such, fastened in a suitable support structure for installation. The insolation shields can also be implemented as so-called lamellar blinds, in which at least part of the lamellae (not shown) comprise a solar energy converter, or the lamellae consist of solar panels. These lamellae are arranged to be turnable in relation to the longitudinal axis, and they can be moved away from the front of the window, if necessary. The insolation shields 3 according to this embodiment are primarily intended to be placed on the side of the room in the same way as lamella blinds of prior art.

The insolation shields 3 according to the invention can also be implemented as Venetian blinds. Thus, the solar energy converters should be relatively narrow, if the insolation shields 3 are intended to be placed in the window interspace. When the insolation shields are placed outside or inside a window, it is also possible to use wider shield elements 8, if necessary.

The solar energy converters used in the above-presented embodiments were solar panels for generating electric energy from solar energy; however, in the insolation shield according to the invention, it is also possible to use so-called solar cells to generate thermal energy from solar energy. Thus, the energy conductors used are tubes or the like which are filled with a flowing medium, such as a glycol-containing fluid. Thus, thermal energy can be transferred from the solar cell either directly to a target of consumption, such as for heating of a room, or the thermal energy can be conducted to be stored, for example, in the soil, from which thermal energy can be conducted into the room, for example with a thermal pump, if necessary. The heat transfer from the flowing medium of the solar cell to the target of consumption or storage can be implemented, for example, by a heat exchanger or by another method known as such.

It is obvious that the present invention is not limited solely to the above-presented embodiments but it can be modified within the scope of the appended claims.

What is claimed is:

1. An insolation shield system (3) comprising at least one shield element (8) which is arranged to be placed in connection with a building (1) to suppress solar radiation incident on the building, at least one shield element (8) of the insolation shield system (3) comprises at least one solar energy converter (4) for conducting incident solar energy to a target of consumption and/or storage, and that the insolation shield system comprises at least one control means (10) provided with means (11, 12) for measuring the intensity of solar radiation to determine the direction of incident sunbeams, wherein the position of said at least one shield element (8) is arranged to be adjusted on the basis of the direction of incident sunbeams on the control element (10), characterized in that the first measuring means (11) and the second measuring means (12) are placed in a position, in which a surface of the first measuring means (11) is directed on a different direction than a surface of the second measuring means (12), the insolation shield system being without a separate shielding device for the first (11) and second measuring means (12), wherein the position of the control element (10) is arranged to be amended so that the surface of the first measuring means (11) and the surface of the second measuring means (12) are at an angle $\alpha$ to the normal of the direction of the incident sunbeams; and the control means is positioned between the first measuring means and the second measuring means and the first measuring means and the second measuring means form two sides of an isosceles triangle relative to the shield element.

2. The insolation shield system according to claim 1, characterized in that said means (11, 12) for measuring the intensity of solar radiation comprise a first (11) and a second (12) measuring means arranged to generate a signal proportional to the intensity of incident light on the measuring means (11, 12), and that the insolation shield system comprises means (13) for generating a difference signal between the signal generated by the first measuring means (11) and the signal generated by the second measuring means (12), and means (14) for adjusting the position of said at least one shield element (8) on the basis of said difference signal.

3. The insolation shield system according to claim 2, characterized in that the change in the position of the shield element (8) is arranged to change the position of said control element (10) in relation to the direction of sunbeams incident on the control element (10).

4. The insolation shield system according to claim 3, characterized in that said control means (10) is fastened to one shield element (8), wherein the surface of the first measuring means (11) and the surface of the second measuring means (12) are at an angle $\alpha$ to the normal of the shield element (8).

5. The insolation shield system according to claim 2, characterized in that the position of said at least one shield element (8) is arranged to be adjusted to achieve the minimum value of said difference signal.

6. The insolation shield system according to claim 1, characterized in that said control means (10) is fastened to the wall of the building.

7. The insolation shield system according to claim 1, characterized in that said control means (10) is placed on the roof of the building.

8. The insolation shield system according to claim 1, characterized in that said building comprises at least one room with a window (2), and that said at least one shield element (8) is arranged to be placed in connection with the window (2) of said room.

9. The insolation shield system according to claim 1, characterized in that the solar energy converter (4) comprises a solar energy converter for generating electrical energy from solar energy.

10. The insolation shield system according to claim 1, characterized in that the solar energy converter (4) comprises a solar cell for generating thermal energy from solar energy.

11. The insolation shield system according to claim 1, characterized in that the shield elements (8) are arranged to be rotatable in the direction of the longitudinal axis.

12. The insolation shield system according to claim 1, characterized in that it is arranged to be fastened to the outer wall of the building (1).

13. The insolation shield system according to claim 1, characterized in that a window comprises at least two panes which are placed at a distance from each other, and that the insolation shield is arranged to be placed between the two panes in the window (2).

14. The insolation shield system according to claim 1, characterized in that it is arranged to be placed in a room.

15. The insolation shield system according to claim 1, characterized in that the angle $\alpha$ is substantially 90°.

16. The insolation shield according to claim 1, characterized in that said control means (10) is attached to one shield element (8).

17. A method for suppressing incident solar radiation on a building by means of at least one insolation shield (3) comprising at least one shield element (8), and in which method the insolation shield (3) is placed in connection with a building (1), at least one shield element (8) of the insolation shield (3) comprises at least one solar energy converter (4), wherein solar energy directed at the solar energy converter is conducted to a target of consumption and/or storage, and the at least one control means (10) is used to measure the intensity of solar radiation to determine the direction of incident sunbeams, wherein the position of said at least one shield element (8) is adjusted on the basis of the direction of incident sunbeams characterized in that the first measuring means (11) and the second measuring means (12) are placed in a position, in which the surface of the first measuring means (11) is directed on a different direction than the surface of the second measuring means (12), the insolation shield system being without a separate shielding device for the first (11) and second measuring means (12), wherein the position of the control element (10) is amended so that the surface of the first measuring means (11) and the surface of the second measuring means (12) are at an angle $\alpha$ to the normal of the direction of the incident sunbeams; and the control means is positioned between the first measuring means and the second measuring means and the first measuring means and the second measuring means form two sides of an isosceles triangle relative to the shield element.

* * * * *